US009545661B2

(12) United States Patent
Li

(10) Patent No.: US 9,545,661 B2
(45) Date of Patent: Jan. 17, 2017

(54) CASTING METHOD FOR MANUFACTURING A GOLF CLUB HEAD HAVING AN EMBEDDED HETEROGENEOUS MATERIAL

(71) Applicant: FUSHENG PRECISION CO., LTD., Taipei (TW)

(72) Inventor: Chien-Liang Li, Taipei (TW)

(73) Assignee: Fusheng Precision Co., Ltd., Taipei (TW)

( * ) Notice: Subject to any disclaimer, the term of this patent is extended or adjusted under 35 U.S.C. 154(b) by 116 days.

(21) Appl. No.: 14/578,548

(22) Filed: Dec. 22, 2014

(65) Prior Publication Data

US 2015/0190686 A1 Jul. 9, 2015

(30) Foreign Application Priority Data

Jan. 3, 2014 (TW) ..... 103100288 A

(51) Int. Cl.
*B22C 9/06* (2006.01)
*B22D 13/04* (2006.01)
(Continued)

(52) U.S. Cl.
CPC ..... *B22C 9/04* (2013.01); *A63B 53/02* (2013.01); *A63B 53/047* (2013.01); *A63B 53/0466* (2013.01); *A63B 53/0487* (2013.01); *A63B 60/02* (2015.10); *B22C 7/02* (2013.01); *B22D 13/04* (2013.01); *B22D 13/06* (2013.01); *B22D 13/101* (2013.01); *B22D 13/107* (2013.01); *B22D 13/108* (2013.01); *B22D 19/16* (2013.01);
(Continued)

(58) Field of Classification Search
CPC ..... B22C 9/04; B22C 9/043; B22D 13/04; B22D 13/101; B22D 13/107; B22D 13/108; B22D 19/16
USPC ..... 164/35, 61, 114, 55.1, 332, 112
See application file for complete search history.

(56) References Cited

U.S. PATENT DOCUMENTS 7,513,296 B1 * 4/2009 Yu et al. ..... B22C 9/04 164/35
8,167,023 B2 5/2012 Renkel
(Continued)

FOREIGN PATENT DOCUMENTS

CN 1899724 A 1/2007
JP H03275266 A 12/1991
(Continued)

*Primary Examiner* — Kevin P Kerns
(74) *Attorney, Agent, or Firm* — Alan D. Kamrath; Kamrath IP Lawfirm, P.A.

(57) ABSTRACT

A method includes placing a shell mold with a crucible portion and a casting portion in communication with the crucible portion on a rotary table, with the heterogeneous material including an embedded portion inlaying in the casting portion of the shell mold and a non-embedded portion locating in a cavity of the casting portion, placing a metal ingot into the crucible portion, followed by melting the metal ingot into molten metal in a vacuum environment, rotating the rotary table, causing the molten metal to flow into the cavity, destroying the shell mold after the molten metal solidifies to obtain a casting including a cast product portion separated from the casting to obtain a cast product of a golf club head, and removing the embedded portion of the heterogeneous material protruding from an outer periphery of the cast product of the golf club head.

15 Claims, 13 Drawing Sheets

(51) Int. Cl.

| | |
|---|---|
| ***B22D 13/10*** | (2006.01) |
| ***B22D 19/16*** | (2006.01) |
| ***B22C 9/04*** | (2006.01) |
| ***B22C 7/02*** | (2006.01) |
| ***B22D 13/06*** | (2006.01) |
| ***A63B 53/02*** | (2015.01) |
| ***A63B 53/04*** | (2015.01) |

(52) U.S. Cl.
CPC .. *A63B 2053/042* (2013.01); *A63B 2053/0433* (2013.01); *A63B 2053/0491* (2013.01)

(56) References Cited

U.S. PATENT DOCUMENTS

| | | | | |
|---|---|---|---|---|
| 2003/0042001 | A1* | 3/2003 | Ray et al. | B22C 3/00 164/529 |
| 2011/0094705 | A1* | 4/2011 | Kelly et al. | B22D 13/00 164/493 |

FOREIGN PATENT DOCUMENTS

| | | | |
|---|---|---|---|
| JP | H08322971 | A | 12/1996 |
| JP | 2002301553 | A | 10/2002 |
| TW | 201215467 | A | 4/2012 |

* cited by examiner

CASTING METHOD FOR MANUFACTURING A GOLF CLUB HEAD HAVING AN EMBEDDED HETEROGENEOUS MATERIAL

BACKGROUND OF THE INVENTION

1. Field of the Invention

The present invention generally relates to a casting method for manufacturing a golf club head and, more particularly, to a casting method for manufacturing a golf club head having an embedded heterogeneous material different from the cast material.

2. Description of the Related Art

In order to meet the needs of a low and deep gravity center, vibration resistance and a comfortable hitting feeling, heterogeneous material different from cast material is currently used in several kinds of golf club heads. By embedding the heterogeneous material into the golf club head, the gravity center of the golf club head and the feeling of the user hitting a golf ball can be adjusted. The heterogeneous material is usually used in the toe, the sole, the heel, the back, the hosel or the striking face of the body of the golf club heads.

Current golf club heads are manufactured by using a high frequency induction furnace to rapidly melt the cast materials in the atmosphere, followed by removing slag and gases in the molten metal by slagging and refinery, Static gravity pouring is then carried out. For maintaining the flowability of the molten metal, the shell mold should be preheated at a high temperature before the pouring process. However, when manufacturing the golf club head with the heterogeneous material, the heterogeneous material in the shell mold is apt to react with oxygen in the air, forming an oxide layer on the surface of the heterogeneous material. Therefore, the coupling strength between the cast material and the heterogeneous material is decreased. Moreover, the heterogeneous material has a thermal expansion coefficient different from the cast material, such that the high temperature used to heat the shell mold during the gravity pouring process often easily causes loosening between the cast material and the heterogeneous material after cooling.

In addition, the static gravity pouring requires additional cast material to maintain the pressing effect of the molten metal and to improve the yield rate of the golf club heads. However, the use of additional cast material and energy for melting the additional cast material results in a higher cost.

Furthermore, if the cast material contains active metals, rigorous oxidation of the active metals may easily occur during the smelting process of the cast material. This not only increases the difficulty in melting but also easily causes oxidative fire cracks due to the reaction with air during the pouring process. As a result, appearance defects, such as sesame dot defects and black bean defects, are apt to be formed on the cast products of the golf club heads. In the worse situations, the reactive gas forms a large number of slag holes or blowholes in the cast products of the golf club heads and, thus, adversely affects the tensile strength of the golf club heads. Moreover, rigorous oxidation also reduces the flowability of the molten metal in the shell mold, leading to a reduced yield rate of the cast products of the golf club heads due to insufficient pouring or resulting in gaps in the cast products of the golf club heads due to cold shut. The tensile strength of the cast products of the golf club heads is also adversely affected. As a result, the yield rate of the cast products of the golf club heads with active metals manufactured by static gravity pouring in the atmosphere is severely decreased.

In light of this, it is necessary to improve the conventional method for manufacturing a golf club head.

SUMMARY OF THE INVENTION

It is therefore the objective of an embodiment of the present invention to provide a casting method for manufacturing a golf club head with a heterogeneous material to reduce the chemical reaction of the heterogeneous material with air during the smelting process, increasing the coupling strength between the cast material and the heterogeneous material (whether with or without active metals) and improving the yield rate and quality of the cast products.

It is another objective of an embodiment of the invention to provide a casting method for manufacturing a golf club head with a heterogeneous material for increasing the flowability of the molten metal in a shell mold. Thus, the shell mold can be preheated at a lower temperature, reducing the thermal expansion of the heterogeneous material and maintaining the tight coupling between the cast material and the heterogeneous material.

It is also another objective of an embodiment of the invention to provide a casting method for manufacturing a golf club head with a heterogeneous material to reduce the manufacturing cost without using additional cast material to maintain the pressing effect of the molten metal.

It is yet another objective of an embodiment of the invention to provide a shell mold with an enhanced coupling strength between the cast material and the heterogeneous material.

The present invention fulfills the above objectives by providing a casting method for manufacturing a golf club head with an embedded heterogeneous material, which comprises the following steps. A shell mold including a crucible portion, a casting portion with a cavity, and a coupling portion in intercommunication between the crucible portion and the casting portion is placed a shell mold on a rotary table. A heterogeneous material including an embedded portion embedded in the casting portion and a non-embedded portion remaining in the cavity of the casting portion is partially embedded in the casting portion of the shell mold. A metal ingot is placed in the crucible portion of the shell mold. The metal ingot is melted into molten metal in a vacuum environment. The rotating shaft is driven to rotate the rotary table, causing the molten metal to flow into the cavity of the casting portion under a centrifugal force generated by the rotation. The non-embedded portion of the heterogeneous material is enclosed with the molten metal. After the molten metal cools and solidifies, the rotating shaft is gradually slowed down until the rotating shaft stops. After the molten metal completely solidifies, the shell mold is destroyed to obtain a casting comprising a cast product portion. The cast product portion is separated from the casting to obtain a cast product of a golf club head, with the embedded portion protruding from an outer periphery of the cast product of the golf club head. The outer periphery of the cast product of the golf club head is milled to remove the embedded portion that protrudes from the outer periphery of the cast product of the golf club head.

In a preferred form shown, formation of the shell mold further includes the following substeps. A wax blank including a crucible blank, a casting blank, a coupling blank and the heterogeneous material is prepared, with the coupling blank having an end connected with an outer periphery of the crucible blank and another end connected with the casting blank, and with the non-embedded portion of the heterogeneous material remaining in the casting blank and the embedded portion of the heterogeneous material protruding from the outer periphery of the casting blank. An enveloping layer is formed on an outer surface of the wax blank. The wax blank and the enveloping layer are heated to melt the wax. The dewaxed enveloping layer is sintered at a high temperature to form the shell mold. The crucible portion, the coupling portion and the casting portion of the shell mold are integrally formed together.

In a preferred form shown, the method further includes the following step. The heterogeneous material is partially embedded in a molten wax in an injection molding manner, to form the casting blank after the molten wax cools and solidifies.

In a preferred form shown, the method further includes the following step. The rotary table is rotated at a speed of 200-700 rpm, to allow the molten metal to flow into the cavity of the casting portion, to fill the cavity of the casting portion with the molten metal.

In a preferred form shown, the method further includes the following steps. The rotating speed of the rotary table is maintained at 200-700 rpm for 10-30 seconds. After the molten metal completely cools and solidifies, the rotary table is gradually slowed down until the rotary table stops.

In a preferred form shown, the method further includes the following steps. After the rotating shaft is completely stopped, the shell mold is removed from the rotary table. The shell mold is restricted from movement for a period of time. The shell mold is destroyed after the molten metal completely solidifies. Alternatively, after the rotary table stops rotating, the shell mold is constantly cooled on the rotary table. After the molten metal in the shell mold completely solidifies, the shell mold is removed from the rotary table and destroyed.

In a preferred form shown, the method further includes the following steps. The metal ingot in the crucible portion of the shell mold is melted into molten metal in the vacuum environment with an activated heater. The activated heater surrounds the crucible portion of the shell mold and heats the crucible portion. Moreover, the method further includes the following step. After the metal ingot is melted into molten metal, the activated heater is moved upward to a preset location surrounding the crucible portion by a lift controller and moved downward to a position not surrounding the crucible portion by the lift controller.

The present invention also fulfills the above objectives by providing a shell mold including a crucible portion, a casting portion, a coupling portion and a heterogeneous material. The coupling portion intercommunicates between the crucible portion and the casting portion. The casting portion includes a cavity. The heterogeneous material includes an embedded portion and a non-embedded portion coupling to the embedded portion, with the embedded portion inlaying in the casting portion of the shell mold and the non-embedded portion locating in the cavity of the casting portion.

In a preferred form shown, the embedded portion includes a first hook portion with a maximum sectional width larger than a sectional width of a part of the embedded portion that is connected to the non-embedded portion. Similarly, the non-embedded portion includes a second hook portion with a maximum sectional width larger than a sectional width of a part of the non-embedded portion that is connected to the embedded portion.

In a preferred form shown, the non-embedded portion includes a taper with a sectional width reducing from the non-embedded portion to the embedded portion.

In a preferred form shown, the embedded portion of the heterogeneous material has an average cross sectional area smaller than an average cross section area of the non-embedded portion of the heterogeneous material.

In a preferred form shown, the non-embedded portion of the heterogeneous material includes a large sectional area region and a small sectional area region. The small sectional area intercommunicates with the embedded portion of the heterogeneous material and the large sectional area region. The small sectional area has a maximum sectional area smaller than ⅔ and larger than 1/10 of the minimum sectional area of the large sectional area, forming a distance between the large sectional area of the casting cover portion and an inner periphery of the cavity.

In a preferred form shown, formation of the shell mold further includes the following substeps. A wax blank including a crucible blank, a casting blank, a coupling blank and the heterogeneous material is prepared, with the coupling blank having an end connected with an outer periphery of the crucible blank and another end connected with the casting blank, and with the non-embedded portion of the heterogeneous material remaining in the casting blank and the embedded portion of the heterogeneous material protruding from the outer periphery of the casting blank. An enveloping layer is formed on an outer surface of the wax blank. The wax blank and the enveloping layer are heated to melt the wax. The dewaxed enveloping layer is sintered at a high temperature to form the shell mold. The crucible portion, the coupling portion and the casting portion of the shell mold are integrally formed together.

In a preferred form shown, the casting blank of the wax blank has a filling portion on the surface of the heterogeneous material. The filling portion is adjacent to the heterogeneous material and is in a form of a protruded edge or a plurality of protruded spots.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
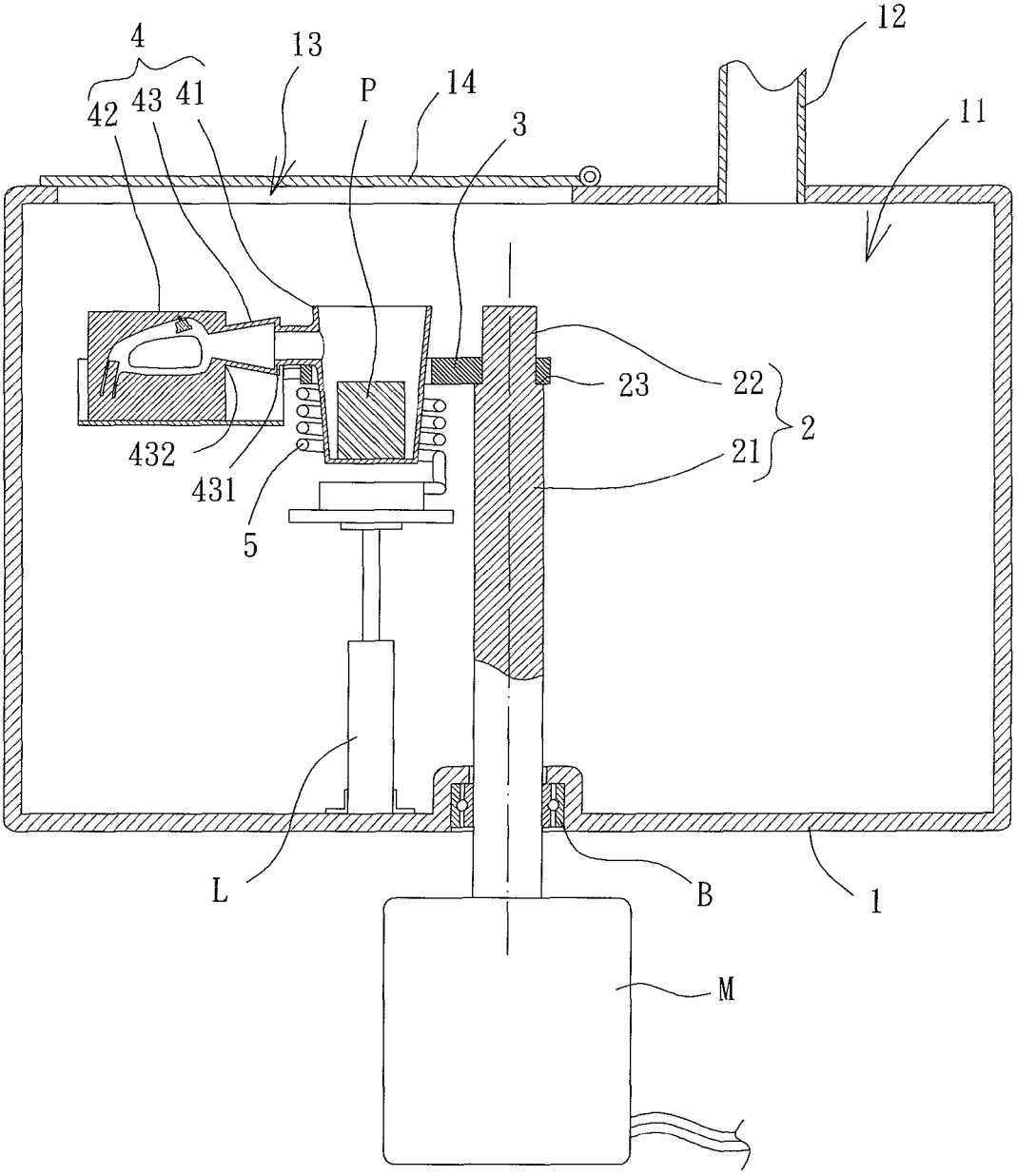
FIG. 1 is a diagrammatic cross sectional view of a vacuum centrifugal casting device capable of carrying out a casting method for manufacturing a golf club head according to the present invention.

In the various figures of the drawings, the same numerals designate the same or similar parts. Furthermore, when the term "first", "second", "third", "fourth", "inner", "outer", "top", "bottom" and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

FIG. 1 is a diagrammatic cross sectional view of a vacuum centrifugal casting device capable of carrying out a casting method for manufacturing a golf club head with a heterogeneous material according to the present invention. The vacuum centrifugal casting device includes a vacuum furnace 1, a rotating shaft 2, a rotary table 3, a shell mold 4 and a heater 5. The rotating shaft 2, the rotary table 3, the shell mold 4 and the heater 5 are mounted in the vacuum furnace 1. The rotary table 3 is connected to the rotating shaft 2 to rotate synchronously with the rotating shaft 2. The shell mold 4 is placed on the rotary table 3. The heater 5 is used to heat the shell mold 4.

Specifically, the vacuum furnace 1 includes a chamber 11. A gas-guiding tube 12 can be mounted to the vacuum furnace 1 and intercommunicates with the chamber 11. A vacuum controller (not shown) can be operated to control the vacuum level in the chamber 11 by drawing gas out of the chamber 11 via the gas-guiding tube 12 according to the preset values. Furthermore, the vacuum furnace 1 can include an opening 13, permitting a user to place an object into the chamber 11 or retrieve the object out of the chamber 11, and a cover 14 can be provided to open or close the opening 13.

Figure 2:
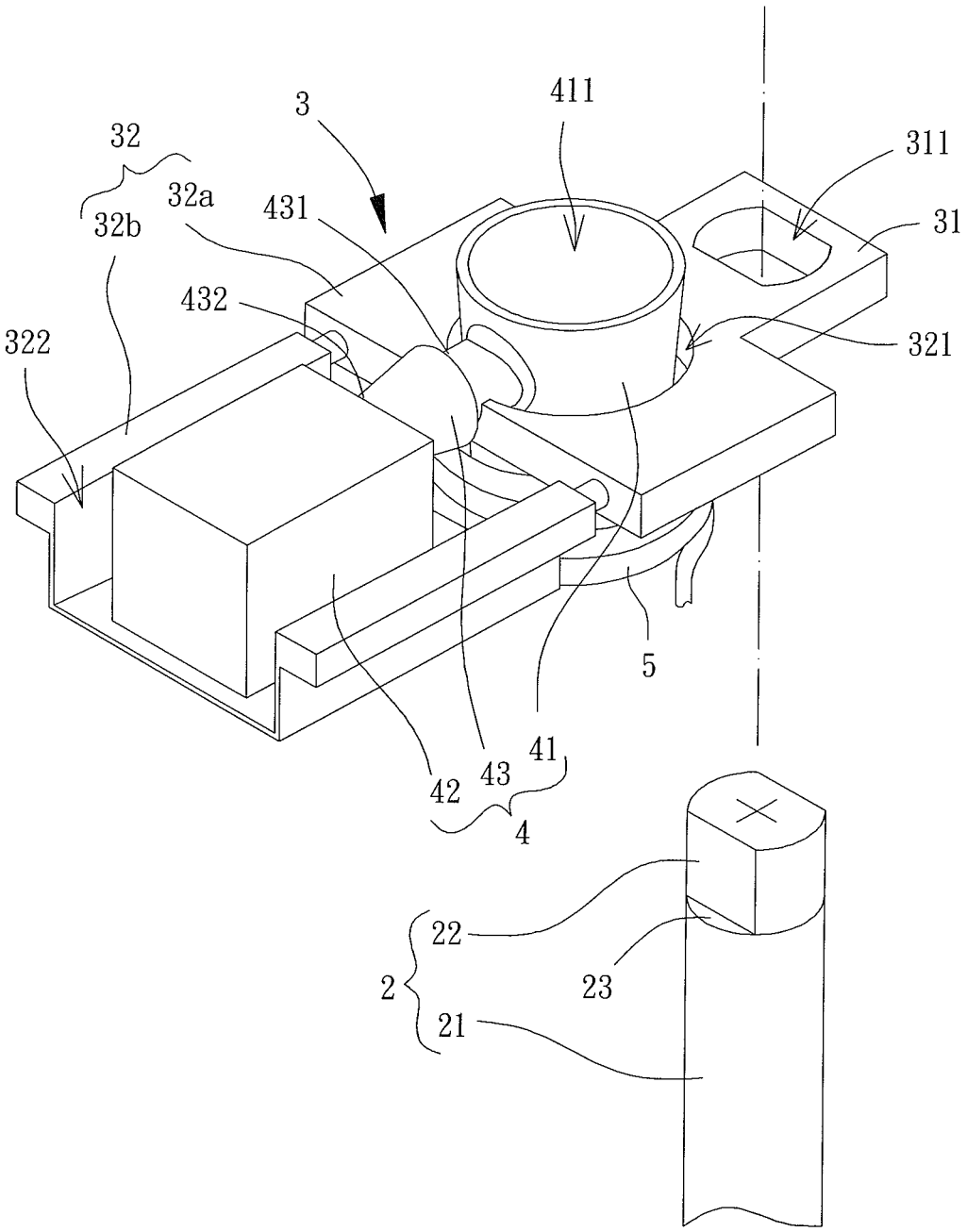
FIG. 2 is an exploded, perspective view of a portion of the vacuum centrifugal casting device of FIG. 1.

With reference to FIGS. 1 and 2, the rotating shaft 2 is mounted in the chamber 11 of the vacuum furnace 1 and is rotatable about a rotating axis. In this embodiment, the rotating shaft 2 is coupled to an output end of a motor "M" and can be driven by the motor "M" to rotate. The motor "M" can be mounted outside of the vacuum furnace 1, and an end of the rotating shaft 2 extends outside of the vacuum furnace 1 and is connected to the motor "M." The rotating shaft 2 can be received in a bearing "B" fixed to the vacuum furnace 1, increasing rotating stability of the rotating shaft 2 and preventing wobbling of the rotating shaft 2 during rotation.

Furthermore, a portion of the rotating shaft 2 in the chamber 11 can include a body 21 and a stop portion 22. Cross sections of the body 21 perpendicular to the rotating axis are different from cross sections of the stop portion 22 perpendicular to the rotating axis, forming an abutment portion 23 at an intersection between the body 21 and the stop portion 22. The rotary table 3 is coupled to the stop portion 22 and abuts the abutment portion 23 such that the rotary table 3 synchronously rotates with the rotating shaft 2. In this embodiment, the cross sections of the body 21 perpendicular to the rotating axis are circular. The stop portion 22 is located on an end of the rotating shaft 2, and the cross sections of the stop portion 22 perpendicular to the rotating axis are non-circular, allowing the rotary table 3 to couple with the stop portion 22 and to abut the abutment portion 23.

Figure 3:
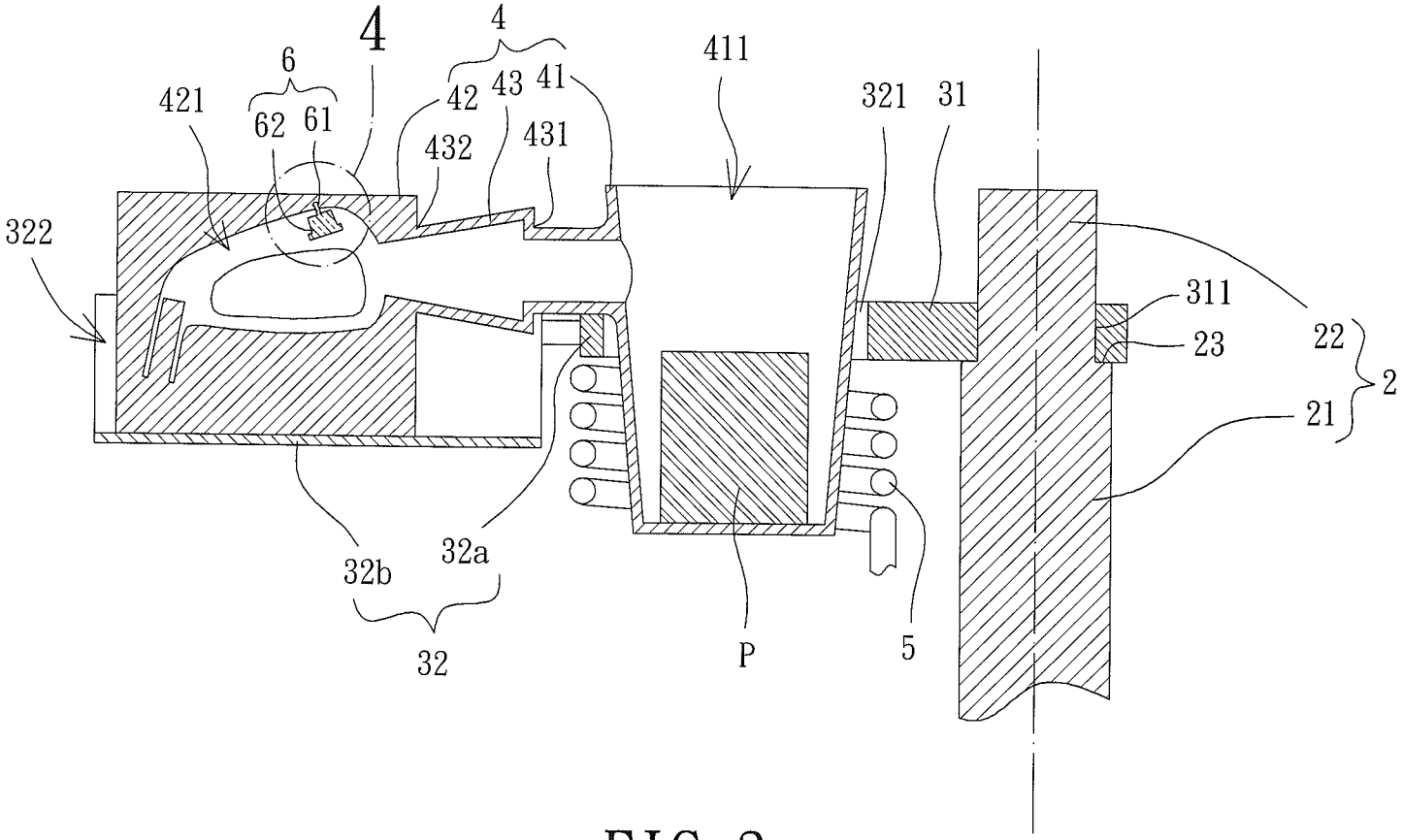
FIG. 3 is a diagrammatic cross sectional view of the portion of the vacuum centrifugal casting device of FIG. 2, illustrating a step of the casting method according to the present invention.

With reference to FIGS. 2 and 3, the rotary table 3 is a carrier on which the shell mold 4 is placed and positioned. The rotary table 3 includes a shaft-coupling portion 31 and a positioning portion 32 coupling with the shaft-coupling portion 31. In this embodiment, the shaft-coupling portion 31 can include a through-hole 311 having cross sections corresponding to the cross sections of the stop portion 22 of the rotating shaft 2. Thus, the through-hole 311 of the shaft-coupling portion 31 of the rotary table 3 receives the stop portion 22 of the rotating shaft 2 for coupling purposes. The positioning portion 32 of the rotary table 3 can be roughly divided into a crucible-positioning portion 32*a* and a cavity-positioning portion 32*b*. The crucible-positioning portion 32*a* is located between the shaft-coupling portion 31 and the cavity-positioning portion 32*b*. Furthermore, the shaft-coupling portion 31, the crucible-positioning portion 32*a* and the cavity-positioning portion 32*b* are arranged in a radial direction perpendicular to the rotating axis. Furthermore, the crucible-positioning portion 32*a* can include a receiving hole 321 for receiving a portion of the shell mold 4. The cavity-positioning portion 32*b* can include a compartment 322 receiving another portion of the shell mold 4.

Referring to FIGS. 2 and 3, the shell mold 4 includes a crucible portion 41, a casting portion 42 and a coupling portion 43. The crucible portion 41 can be substantially cup-shaped and defines a receiving space 411 adapted for receiving metal ingots to be heated to melt. The casting portion 42 is used to form a golf club head. However, the outline of the casting portion 42 is not limited. The casting portion 42 includes a cavity 421 having a shape corresponding to a shape of the cast product of the golf club head to be cast. The cast product of the golf club head can be processed to manufacture any golf club head, such as an iron golf club head, a wooden golf club head or a golf putter head. The iron golf club head is shown in, but not limited to, the drawings of the present invention. The coupling portion 43 is tube-shaped with a first end 431 penetrating an outer periphery of the crucible portion 41 and in communication with the receiving space 411, with a second end 432 in communication with the casting portion 42 and the cavity 421. With such performance, the receiving space 411 of the crucible portion 41 is in communication with the cavity 421 of the casting portion 42.

The crucible portion 41 and the casting portion 42 of the shell mold 4 can be positioned in the crucible-positioning portion 32*a* and the cavity-positioning portion 32*b* of the rotary table 3, respectively. Therefor, the crucible portion 41 is closer to the shaft-coupling portion 31 of the rotary table 3 than the casting portion 42 is to the shaft-coupling portion 31 of the rotary table 3. Thus, as the rotary table 3 is driven to rotate, cast materials received in the receiving space 411 of the crucible portion 41 can flow into the cavity 421 of the casting portion 42 under centrifugal force.

It's worth to mention that, for adjusting the gravity center of the golf club head or the feeling of the user hitting a golf ball, the cavity 421 of the casting portion 42 includes at least one heterogeneous material 6 embedded in the body of the golf club head. A part of the heterogeneous material 6 is embedded in the cavity 421, and another part of the heterogeneous material 6 is embedded in the casting portion 42. As such, the heterogeneous material 6 can remain in the preset location of the cavity 421, such that the heterogeneous material 6 can be enclosed by the cast material flowing into the cavity 421. The cast material flowing into the cavity 421 under a centrifugal force is a high-temperature molten metal used for forming the body of the golf club head. Therefore, the melting point of the heterogeneous material 6 should be higher than the melting point of the cast material to prevent melting of the heterogeneous material 6. The density of the heterogeneous material 6 can be adjusted according to the needs of the manufacturing process. That is, the heterogeneous material 6 having a density lower than the cast material can be used for reducing the local weight of the golf club head. Alternatively, the heterogeneous material 6 having a density higher than the cast material can be used for increasing the local weight of the golf club head.

Figure 4:
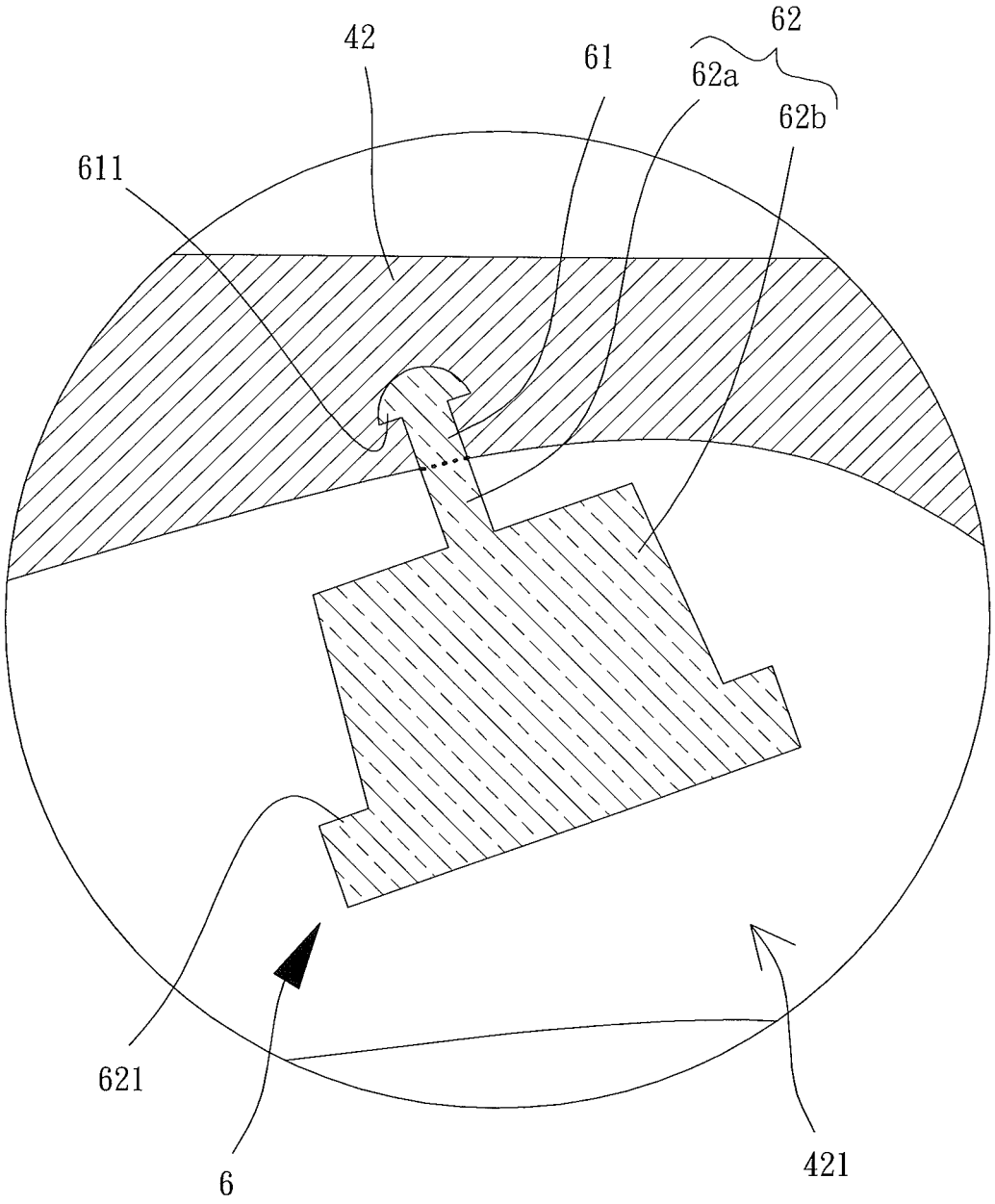
FIG. 4 is an enlarged view of FIG. 3.

Referring to FIG. 4, the shape of the heterogeneous material 6 is not limited. The heterogeneous material 6 can be divided into an embedded portion 61 and a non-embedded portion 62 coupling to the embedded portion 61. The embedded portion 61 is embedded in the casting portion 42 of the shell mold 4, and the non-embedded portion 62 remains in the cavity 421 of the casting portion 42. Preferably, the embedded portion 61 of the heterogeneous material 6 can have a first hook portion 611 with a maximum sectional width larger than a sectional width of the part of the embedded portion 61 connected to the non-embedded portion 62, to enhance the coupling strength between the embedded portion 61 of the heterogeneous material 6 and the casting portion 42 as well as preventing the disengagement of the embedded portion 61 of the heterogeneous material 6 from the casting portion 42. The non-embedded portion 62 of the heterogeneous material 6 can have a second hook portion 621 having a maximum sectional width larger than a sectional width of the part of the non-embedded portion 62 connected to the embedded portion 61, to enhance the coupling effect between the non-embedded portion 62 of the heterogeneous material 6 and the cast product 42 as well as preventing the disengagement of the non-embedded portion 62 of the heterogeneous material 6 from the later-produced cast product. In addition, part of the non-embedded portion 62 of the heterogeneous material 6 can also be in a tapered form having a sectional width reducing from the non-embedded portion 62 to the embedded portion 61, to further enhance the coupling strength between the heterogeneous material 6 and the cast material.

Moreover, because the embedded portion 61 of the heterogeneous material 6 should be milled after the cast product is formed, the embedded portion 61 of the heterogeneous material 6 preferably has a smaller volume. For example, the average cross sectional area of the embedded portion 61 of the heterogeneous material 6 is smaller than the average cross sectional area of the non-embedded portion 62 of the heterogeneous material 6. However, the relationship must be based on the fact that the embedded portion 61 can sufficiently support the non-embedded portion 62, as it can be easily appreciated by a person having ordinary skill in the art.

Furthermore, the outer periphery of the produced cast product will probably have to be milled in order to expose a portion of the non-embedded portion 62 out of the cast product (said portion is the part of the non-embedded portion 62 adjacent to the embedded portion 61). However, the milling process of the heterogeneous material 6 is usually more difficult than the milling process of the cast material. Therefore, the portion of the heterogeneous material 6 exposed outside of the cast product preferably has a cross section as small as possible. In this embodiment, the non-embedded portion 62 of the heterogeneous material 6 can have a small sectional area region 62*a* and a large sectional area region 62*b*, with the small sectional area region 62*a* being interconnected with the embedded portion 61 of the heterogeneous material 6 and the large sectional area region 62*b*. The small sectional area region 62*a* has a maximum sectional area smaller than about ⅔ and larger than 1/10 of the minimum sectional area of the large sectional area region 62*b*, forming a distance between the large sectional area region 62*b* of the non-embedded portion 62 and an inner periphery of the cavity 421. With such performance, the produced cast product can be in a form that can be easily milled. Therefore, the efficiency of milling the cast product is improved, and the wearing of the milling tool is reduced.

Figure 5:
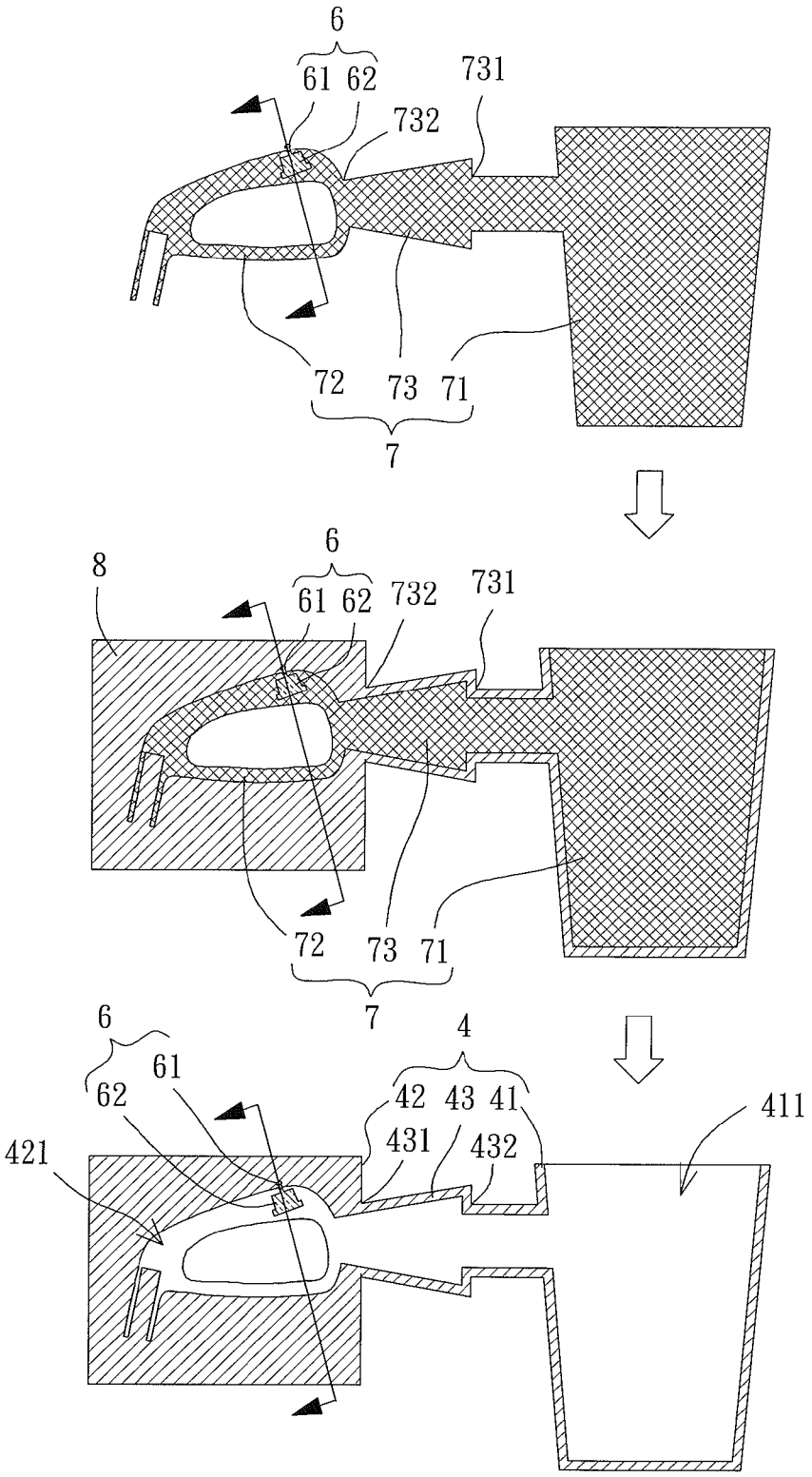
FIG. 5 shows procedures for forming a shell mold of the vacuum centrifugal casting device of FIG. 1.
Figure 6:
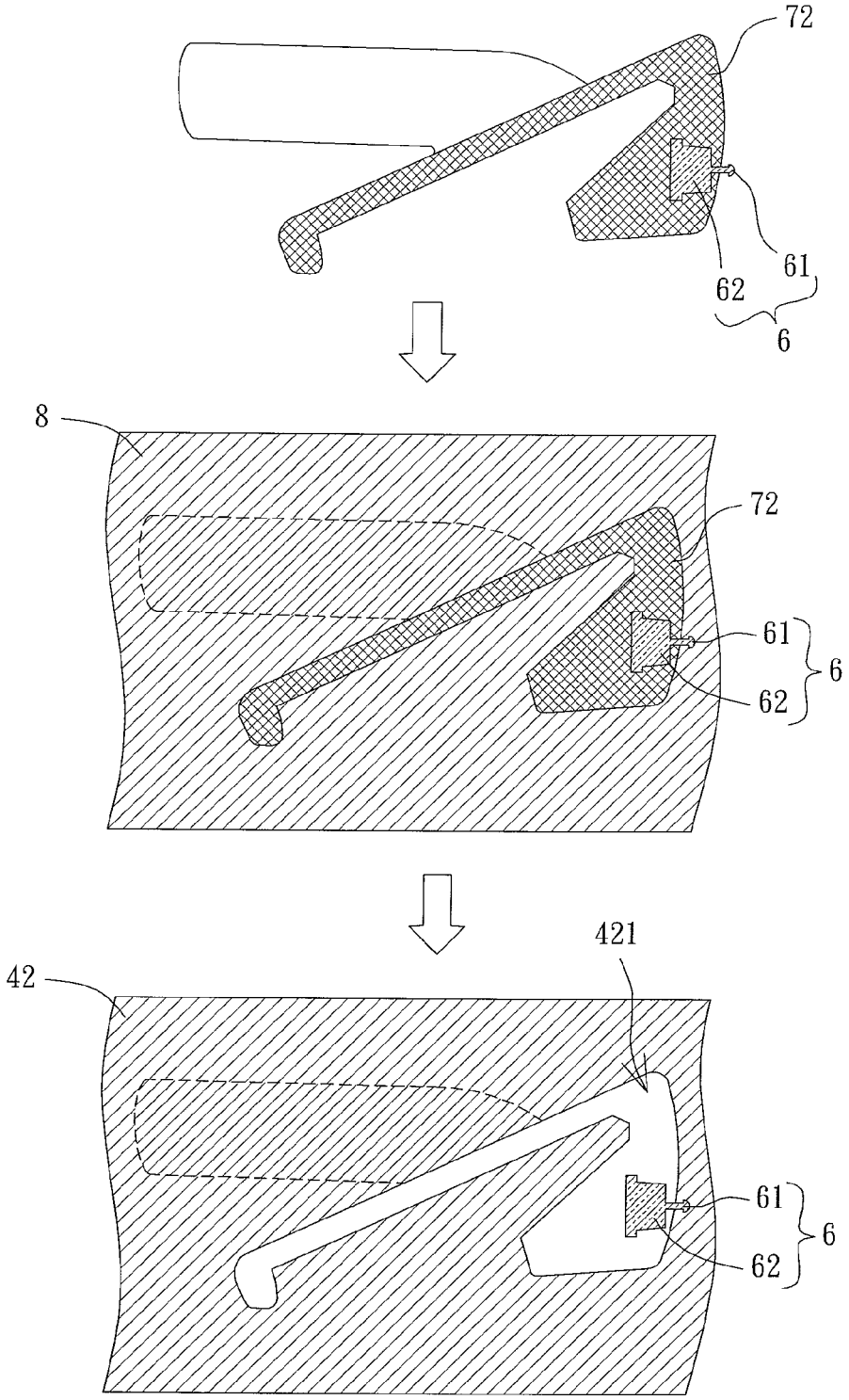
FIG. 6 is another view similar to FIG. 5, illustrating procedures for forming a shell mold of the vacuum centrifugal casting device of FIG. 1.

With reference to FIGS. 5 and 6, the crucible portion 41, the casting portion 42 and the coupling portion 43 of the shell mold 4 are integrally formed with each other. Formation of the shell mold 4 includes preparing a wax blank 7 including a crucible blank 71, a casting blank 72, a coupling blank 73 and the at least one heterogeneous material 6. The crucible blank 71 and the coupling blank 73 are solid $wax_2$ with the coupling blank 73 having a first end 731 coupled with the outer periphery of the crucible blank 71 and a second end 732 coupled with the casting blank 72. The heterogeneous material 6 has the non-embedded portion 62 embedded in the casting blank 72 and the embedded portion 61 protruding from the outer periphery of the casting blank 72. In this embodiment, the heterogeneous material 6 can be enclosed by a molten wax in an injection manner, and the casting blank 72 can be formed after the molten wax cools and solidifies. Therefore, the non-embedded portion 62 of the heterogeneous material 6 can be embedded in the casting blank 72, and the embedded portion 61 of the heterogeneous material can protrude from the outer periphery of the casting blank 72.

It's worth to mention that any portion of the casting blank 72 can be connected to the coupling blank 73. That is to say, any portion of the casting blank 72 can be used as a pouring opening. Moreover, any portion of the casting blank 72 connecting with the coupling blank 73 can include a plurality of portions according to the arrangement of the passage for improving the yield rate of the cast products, which is understood by a person having ordinary skill in the art.

Next, an enveloping layer 8 is formed on an outer surface of the wax blank 7 by dipping, coating or clogging. Then, the wax blank 7 and the enveloping layer 8 are heated to melt the wax. As an example, the wax blank 7 and the enveloping layer. 8 can be heated in a steam autoclave to melt the wax blank 7, and the molten wax flows out of the enveloping layer 8. The dewaxed enveloping layer 8 is sintered at a high temperature to form the integrally formed shell mold 4 including the crucible portion 41, the coupling portion 43 and the casting portion 42, with the embedded portion 61 of the heterogeneous material 6 embedded in the casting portion 42 of the shell mold 4. A fire-resistant material, such as zirconium silicate, yttrium oxide, stabilized zirconium oxide or aluminum oxide, can be used as the material for a surface layer of the shell mold 4. A mullite ($3Al_2O_3$-$2SiO_2$) compound or silicon oxide can be used as a fire-resistant material for a back layer of the shell mold 4. In a case that the back layer uses a mullite compound, the mullite compound preferably contains 45-60 wt % of aluminum oxide and 55-40 wt % of silicon oxide. In another case that the back layer uses a silicon oxide compound, the silicon oxide compound preferably contains more than 95% of silicon oxide.

TABLE 1

| | | | | | | | | | | | |
|---|---|---|---|---|---|---|---|---|---|---|---|
| | Si | Mn | Cr | C | S | Al | | | | | Fe |
| Example 1 | 0.2↓ | 26-29 | 2.6-3.2 | 0.9-1.2 | 0.01↓ | 8.0-9.5 | | | | | Bal |
| | Si | Mn | Cr | Ni | | | | | | | Fe |
| Example 2 | 3.0-5.5 | 8.0-10.5 | 14.5-17.0 | 3.5-6.0 | | | | | | | Bal |
| | Si | Mn | Cr | C | S | P | Ni | Mo | Al | Co | Fe |
| Example 3 | 0.5↓ | 0.5↓ | 10.5-11.5 | 0.015↓ | 0.01↓ | 0.015↓ | 7.5-8.5 | 4.5-5.5 | 1.0-1.5 | 8.0-9.0 | Bal |
| | Si | Mn | Cr | C | S | P | Ni | Mo | Ti | | Fe |
| Example 4 | 0.25↓ | 0.25↓ | 11-12.5 | 0.02↓ | 0.01↓ | 0.015↓ | 10.75-11.25 | 0.7-1.25 | 1.5-1.85 | | Bal |
| | Si | Mn | Cr | C | S | P | Ni | Mo | Ti | Nb | Fe |
| Example 5 | 0.25↓ | 0.25↓ | 11-12.5 | 0.02↓ | 0.01↓ | 0.015↓ | 10.75-11.25 | 0.75-1.25 | 1.55-1.8 | 0.15-0.3 | Bal |
| | Si | Mg | Co | C | S | P | Ni | Mo | Ti | | Fe |
| Example 6 | 0.1↓ | 0.1↓ | 8.0-9.5 | 0.03↓ | 0.01↓ | 0.01↓ | 18.0-19.0 | 4.7-5.1 | 0.5-0.8 | | Bal |
| | Si | Mn | Cr | C | S | P | Ni | Mo | Cu | | Fe |
| Example 7 | 0.5-1.0 | 1-2 | 21.5-23 | 0.05↓ | 0.03↓ | 0.03↓ | 4.8-6.2 | 2.8-3.5 | 0.5↓ | | Bal. |
| | Al | V | Mo | Fe | O | N | | | | | Ti |
| Example 8 | 5.5-6.5 | 3.5-4.5 | — | 0.2↓ | 0.25↓ | 0.05↓ | | | | | Bal. |
| | Al | V | Mo | Fe | O | N | | | | | Ti |
| Example 9 | 7.5-8.5 | 0.75-1.5 | 0.75-1.5 | 0.2↓ | 0.15↓ | 0.05↓ | | | | | Bal. |

With reference to FIGS. 1 and 3, the heater 5 is mounted in the chamber 11 of the vacuum furnace 1 to heat the crucible portion 41 of the shell mold 4. In this embodiment, the heater 5 can be a high frequency coil and is moved inside the chamber 11 by using a lift controller "L." If the crucible portion 41 of the shell mold 4 is to be heated, the heater 5 is moved upward to a preset location surrounding the crucible portion 41 and is activated to heat the crucible portion 41. After heating, the heater 5 is moved downward by the lift controller "L" to a position not surrounding the crucible portion 41, avoiding interference with rotational movement of the shell mold 4 following the rotation of the rotary table 3 and the rotating shaft 2.

The method for manufacturing a golf club head having an embedded heterogeneous material according to the present invention can be implemented and includes the following steps.

With reference to FIGS. 1-3, a shell mold 4 is placed onto a rotary table 3 connected to a rotating shaft 2 rotatable about a rotating axis. Specifically, the rotary table 3 is mounted in a vacuum furnace 1 to control the vacuum level of the space receiving the shell mold 4. Furthermore, the shell mold 4 includes a crucible portion 41 and a casting portion 42 in communication with the crucible portion 41 via a coupling portion 43. Thus, the receiving space 411 of the crucible portion 41 is in intercommunication with the cavity 421 of the casting portion 42. In addition, at least one heterogeneous material 6 has an embedded portion embedded in the casting portion 42 of the shell mold 4 and a non-embedded portion remaining in the cavity 421 of the casting portion 42. The crucible portion 41 of the shell mold 4 can extend through the receiving hole 321 of the rotary table 3, and the coupling portion 43 abuts the rotary table 3. The casting portion 42 of the shell mold 4 can be received in the compartment 322 of the rotary table 3, such that the shell mold 4 is reliably positioned in a predetermined location on the rotary table 3.

At least one metal ingot "P" is placed into the receiving space 411 of the crucible portion 41. In a case that the at least one metal ingot includes only one metal ingot "P", the metal ingot "P" has a composition identical to a composition of a golf club head to be produced. In another case that the at least one metal ingot includes a plurality of metal ingots "P", a composition of the molten metal of the metal ingots "P" is identical to a composition of a golf club head to be produced. As an example, nine examples of the alloy used as the metal ingot "P" are shown in, but not limited to, TABLE 1.

Referring to TABLE 1, the alloy shown as Examples 1 and 2 is an iron-based material containing aluminium (Al), silicon (Si), and manganese (Mn). The iron-based material has an iron content of above 50%, a density of 6.8 g/cm$^3$, a tensile strength of 145-155 ksi, and is belonged belongs to a low-density steel material having a density of 6.5-7.8 g/cm$^3$. Moreover, the alloy shown as Examples 3-6 is an iron-based material containing cobalt (Co), molybdenum (Mo) or titanium (Ti). The iron-based material in Examples 3-6 has an iron content of above 50%, a density of 7.8 g/cm$^3$, a tensile strength of 250-350 ksi, and belongs to a high-strength steel material having a tensile strength of above 240 ksi. Furthermore, the alloy shown as Example 7 is an iron-based material with a chromium content of 15-30 wt %, a density of 7.5-8 g/cm$^3$ and a tensile strength of 90-110 ksi. Finally, the alloy shown as Examples 8-9 is titanium alloy having a titanium content of 85-95 wt %, a density of 4.2-4.6 g/cm$^3$ and a tensile strength of 100-150 ksi.

Figure 7:
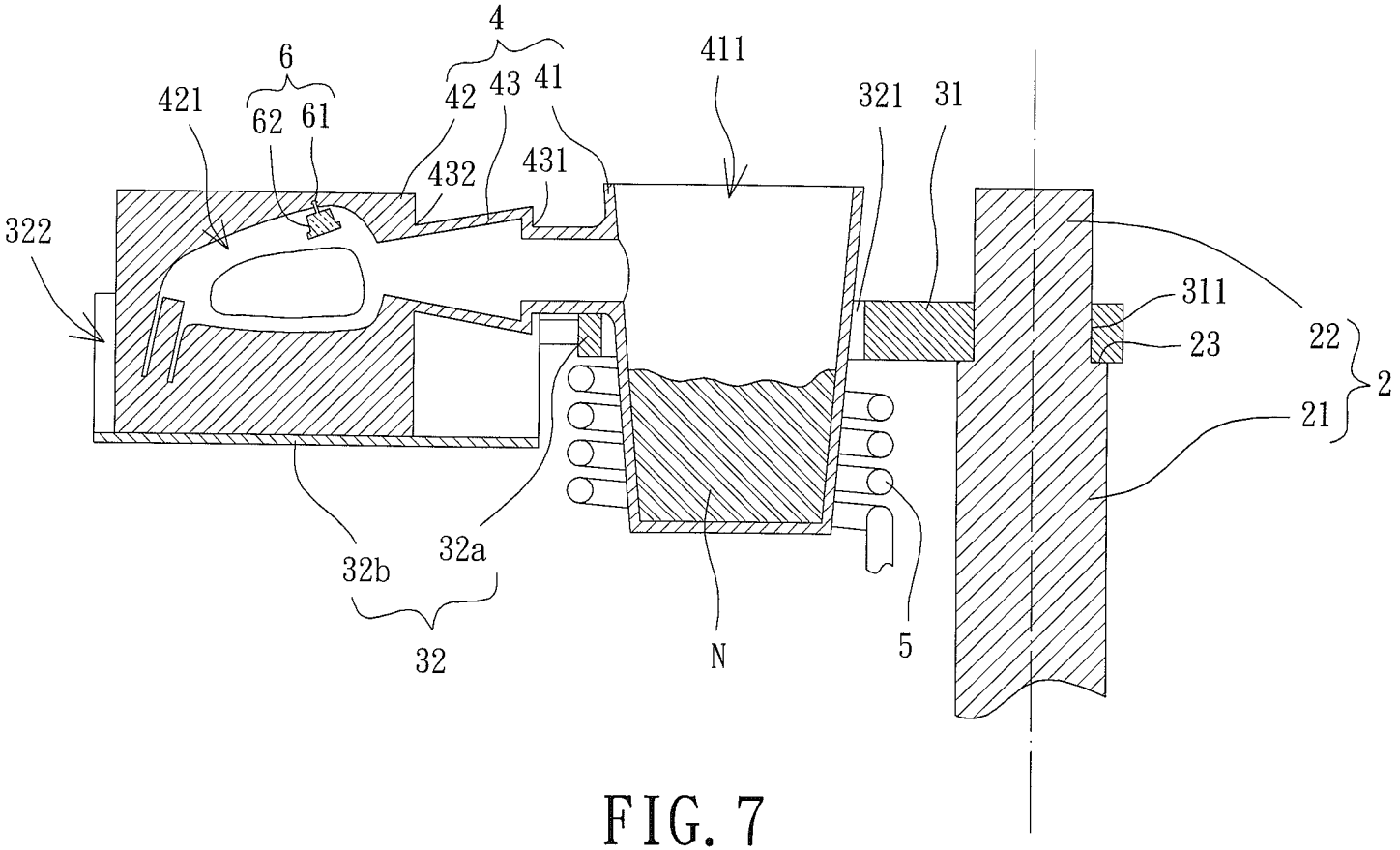
FIG. 7 is a view similar to FIG. 5, illustrating another step of the casting method according to the present invention.

With reference to FIGS. 1 and 7, the at least one metal ingot "P" is heated into molten metal "N" in a vacuum environment. Specifically, after the shell mold 4 is positioned, the heater 5 can be lifted to the preset location surrounding the crucible portion 41, and the gas in the chamber 11 of the vacuum furnace 1 is drawn out via the gas-guiding tube 12 to control the vacuum level. After the vacuum level reaches a preset value (such as smaller than 0.3 mbar), the heater 5 can be activated to heat the crucible portion 41 of the shell mold 4 and, thus, melt the at least one metal ingot "P" in the crucible portion 41 into molten metal "N." When the heater 5 operates, the frequency and the power of the power supply can be 4-30 kHz and 5-100 kW, respectively. After the at least one metal ingot "P" melts into molten metal "N", the heater 5 is stopped and is rapidly moved downward to a location not surrounding the crucible portion 41.

Figure 8:
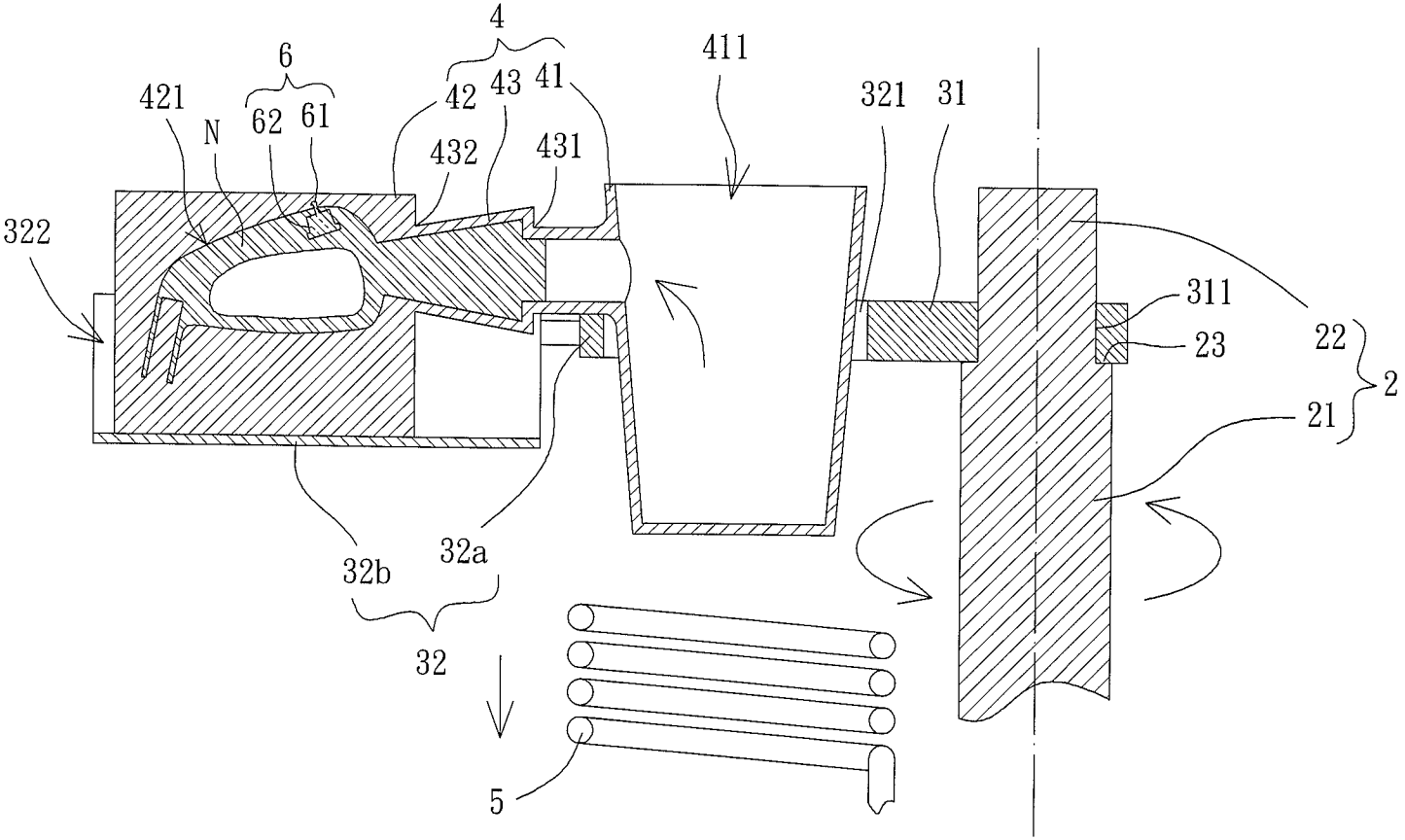
FIG. 8 is a view similar to FIG. 5, illustrating yet another step of the casting method according to the present invention.

With reference to FIGS. 1 and 8, the rotating shaft 2 is driven to rotate the rotary table 3, causing the molten metal "N" to flow into the cavity 421 of the casting portion 42 under centrifugal force and enclosing the non-embedded portion 62 of the heterogeneous material 6 located in the cavity 421. Specifically, the rotating shaft 2 is driven by the motor "M" to rotate about the rotating axis at a speed of about 200-700 rpm. The rotating speed can be adjusted according to the thickness of the cast product (i.e., the volume of the cavity 421). When the rotary table 3 is actuated to rotate about the rotating axis, the molten metal "N" flows along the inner periphery of the crucible portion 41 of the shell mold 4 under the centrifugal force and passes through the coupling portion 43 into the casting portion 42 to proceed with the pouring process and, thus, fill the cavity 421 and completely enclose the non-embedded portion 62 of the heterogeneous material 6 located in the cavity 421.

After the pouring process, the rotating shaft 2 is still driven to rotate the rotary table 3. For example, in this embodiment, the rotary table 3 can be driven to rotate about the rotating axis at a speed of about 200-700 rpm for 10-30 seconds until the molten metal "N" at the pouring opening (the interior space of the coupling portion 43 of the shell mold 4) cools and solidifies. Rotating of the rotary table 3 is then slowed and finally stopped. Therefore, during cooling and solidification of the molten metal "N" according to the present invention, the pressing effect of the molten metal "N" is evaluated by the centrifugal force due to the rotation, thereby improving the yield rate of the golf club heads.

Figure 9:
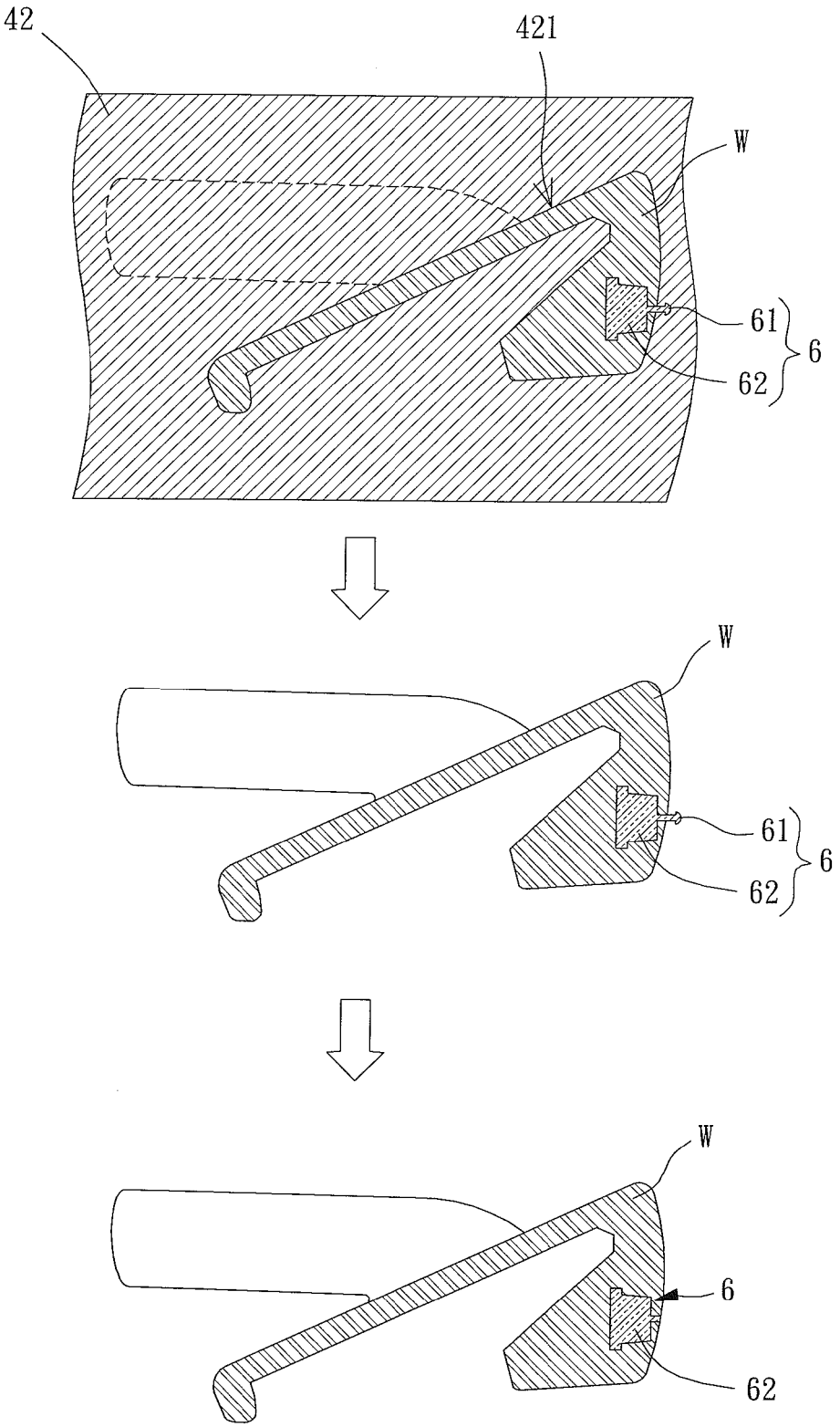
FIG. 9 is a view similar to FIG. 5, illustrating a further step of the casting method according to the present invention.

With reference to FIG. 9, after the molten metal "N" completely solidifies, the shell mold 4 is destroyed to obtain a casting. For example, the shell mold 4 can be removed from the rotary table 3 after the rotating shaft 2 is completely stopped, and the shell mold 4 can be further destroyed after standing for a period of time until the molten metal "N" completely solidifies. As a result, the pouring process of the shell mold 4 is still carried out to improve the manufacturing efficiency. Alternatively, the shell mold 4 can be cooled on the rotary table 3 until the molten metal "N" completely solidifies, followed by the removal of the shell mold 4 from the rotary table 3. Therefore, the molten metal "N" in the cavity 421 can be evenly cooled.

The casting includes a cast product portion. The cast product portion is separated from the casting (such as by cutting the cast product portion from the casting using a cutter or by breaking the cast product portion off the casting under vibration) to obtain at least one cast product of a golf club head "W." The cast product of the golf club head "W" can tightly enclose the non-embedded portion 62 of the heterogeneous material 6 while the embedded portion 61 of the heterogeneous material 6 protrudes from the outer periphery of the cast product of the golf club head "W." Then, a golf club head having an embedded heterogeneous material 6 can be obtained by milling the outer periphery of the cast product of the golf club head "W" by a miller (not shown), removing the portion of the heterogeneous material 6 protruding from the outer periphery of the cast product of the golf club head "W", including the embedded portion 61 and a small portion of the non-embedded portion 62. As such, a finished product of the golf club head having an embedded heterogeneous material 6 can be obtained.

Thus, the casting method for manufacturing a golf club head according to the present invention can be produced in a nearly vacuum environment to reduce the formation of the oxide layer on the surface of the heterogeneous material 6 during the preheating step of the shell mold. Therefore, the coupling strength between the cast material and the heterogeneous material 6 can be improved after the pouring process. The casting method for manufacturing a golf club head according to the present invention can also reduce the chemical reaction of the cast material with air during the smelting process, such that both the cast material (whether with or without active metals) and the metal ingot "P" can easily and more evenly melt to avoid oxidative fire cracks resulting from the reaction with air while the molten metal "N" is flowing from the crucible portion 41 of the shell mold 4 into the casting portion 42. Thus, appearance defects, such as sesame dot defects and black bean defects, are less likely to be formed on the cast product of the golf club head "W." Furthermore, casting defects of slag holes or blowholes formed by the reactive gas are less likely to be generated, increasing the tensile strength of the cast product of the golf club head "W."

Furthermore, reducing the chemical reaction between the molten metal "N" and air also increases the flowability of the molten metal "N" in the shell mold 4. Furthermore, the molten metal "N" is reliably poured into the cavity 421 of the shell mold 4 under centrifugal force before the molten metal "N" re-solidifies, which not only avoids the waste of the cast material due to solidification of a portion of the molten metal "N" in the crucible portion 41 but assures that the casting portion 42 can be filled with the molten metal "N" and that the non-embedded portion 62 of the heterogeneous material 6 can be completely enclosed by the molten metal "N" after the molten metal "N" flows into the casting portion 42. The yield rate of the cast products of the golf club heads can be increased, and the possibility of formation of gaps in the cast products of the golf club heads due to cold shut is reduced. Thus, the tensile strength of the cast product of the golf club head is increased. In addition, the required temperature for preheating the shell mold 4 can be reduced by increasing the flowability of the molten metal "N" under the vacuum environment as well as by further increasing the flowability of the molten metal "N" under centrifugal force. Therefore, the thermal expansion of the heterogeneous material 6 is decreased while maintaining the coupling strength between the cast material and the heterogeneous material 6 after cooling with a plurality of portions for forming the cast product of the golf club head "W"

Figure 10:
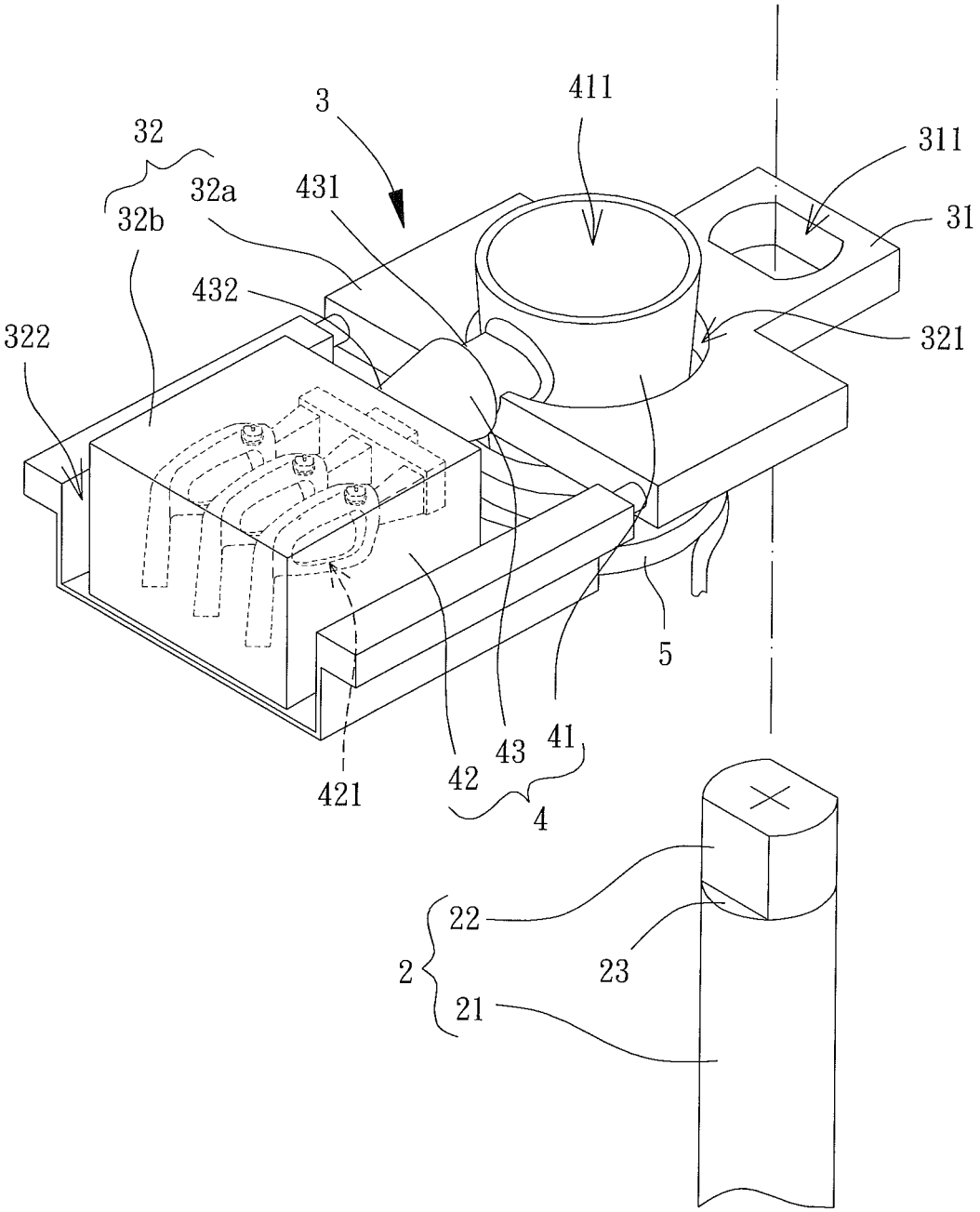
FIG. 10 is an exploded, perspective view of a portion of another vacuum centrifugal casting device capable of carrying out a casting method for manufacturing a golf club head according to the present invention.

Moreover, referring to FIG. 10, another shell mold 4 having a plurality of cavities 421 can be used in the casting method of the present invention to produce a plurality of cast products of the golf club head "W" at one time, thus improving the manufacturing efficiency.

Figure 11:
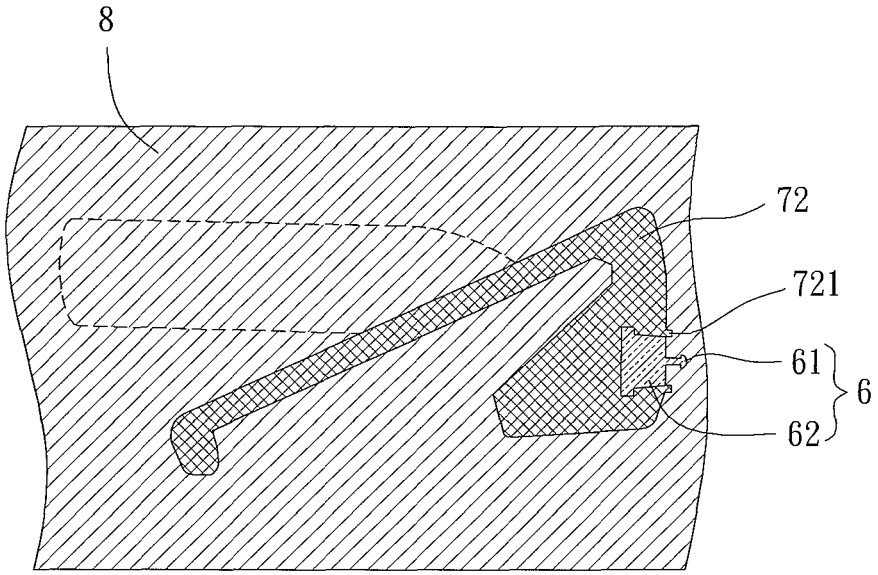
FIG. 11 is a diagrammatic cross sectional view of another shell mold.

With reference to FIG. 11, in another embodiment, if the heterogeneous material 6 to be embedded in the golf club head has a thermal expansion coefficient much different from the cast material, during the formation of the shell mold 4, a filling portion 721 can be arranged on the surface of the casting blank 72 where the heterogeneous material 6 is provided. The filling portion 721 is adjacent to the heterogeneous material 6 and is in the form of a protruded edge or a plurality of protruded spots. Accordingly, the cast product of the golf club head "W" produced from the shell mold 4 can have an extra amount of cast material corresponding to the filling portion 721. The extra amount of cast material can be melted and filled into a gap that is formed due to the large difference in the thermal expansion coefficients between the cast material and the heterogeneous material 6, thus ensuring the coupling strength between the cast material and the heterogeneous material 6. Similarly, the heterogeneous material 6 can have the protruded edge or the plurality of protruded spots arranged adjacent the surface edge of the casting blank 72. In this manner, the protruded edge or the plurality of protruded spots of the heterogeneous material 6 can be melted and filled into the gap between the cast material and the heterogeneous material 6.

Figure 12:
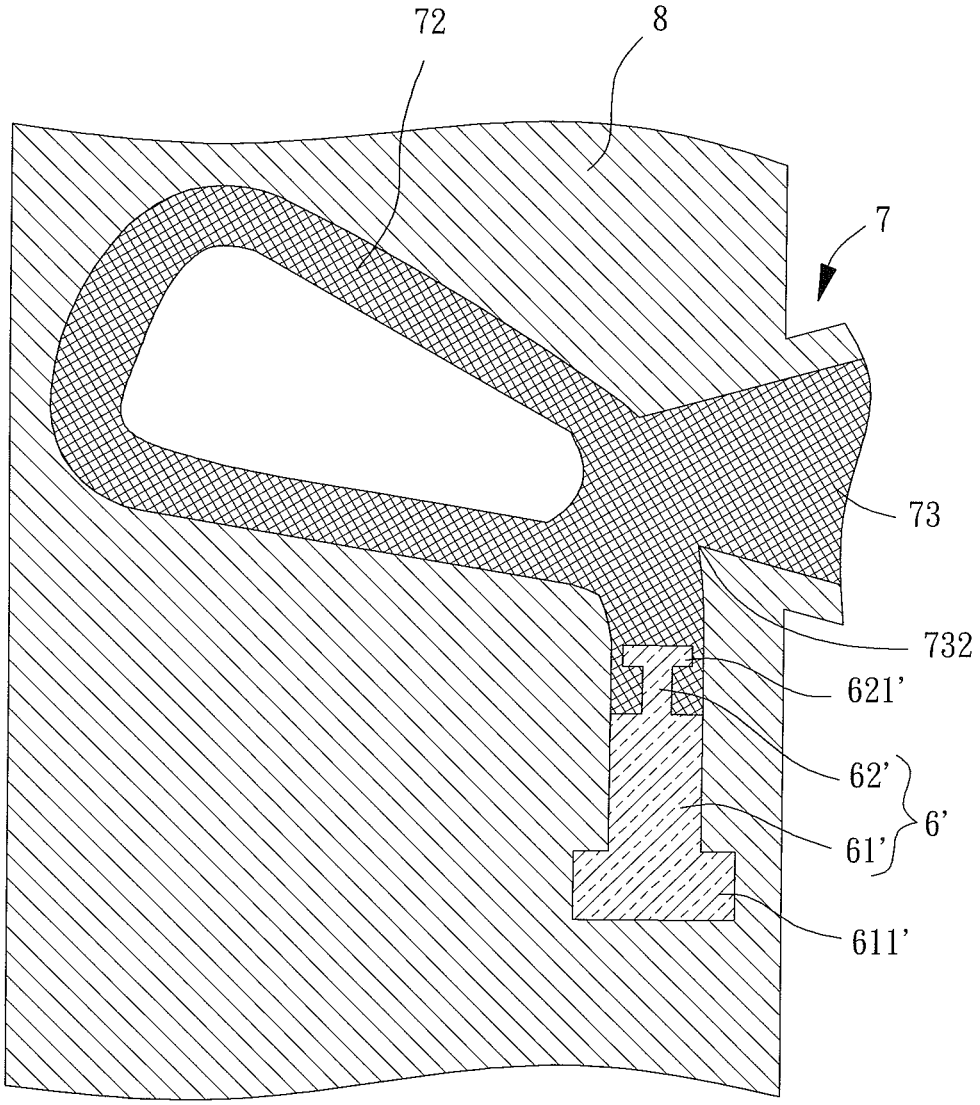
FIG. 12 is a diagrammatic cross sectional view of the wax blank of an embodiment having the hosel with the heterogeneous material.

FIG. 12 shows another embodiment with the heterogeneous material 6' arranged in a hosel of the golf club head. In this embodiment, the heterogeneous material 6' can be the hosel of the cast product of the golf club head "W" or form the hosel of the cast product of the golf club head "W" together with part of the cast product. That is, the embedded portion 61' of the heterogeneous material 6' is only partially milled after the cast product of the golf club head is formed. The embedded portion 61' of the heterogeneous material 6' can have a first hook portion 611' with a maximum sectional width larger than a sectional width of the part of the embedded portion 61' connected to the non-embedded portion 62', to enhance the coupling strength between the embedded portion 61' of the heterogeneous material 6' and the casting portion 42 as well as preventing the disengagement of the embedded portion 61' of the heterogeneous material 6' from the casting portion 42. The non-embedded portion 62' of the heterogeneous material 6' can have a second hook portion 621' having a maximum sectional width larger than a sectional width of the part of the non-embedded portion 62' connected to the embedded portion 61', to enhance the coupling effect between the non-embedded portion 62' of the heterogeneous material 6' and the cast product 42 as well as preventing the disengagement of the non-embedded portion 62' of the heterogeneous material 6' from the later-produced cast product.

Therefore, when the shell mold 4 used in the casting method for manufacturing a golf club head having an embedded heterogeneous material according to the present invention is shaped, the non-embedded portion 62' of the heterogeneous material 6' has the second hook portion 621' embedded in the casting blank 72 of the wax blank 7 and the embedded portion 61' exposed out of the outer periphery of the casting blank 72. When an enveloping layer 8 is formed on the outer surface of the wax blank 7, the embedded portion 61' of the heterogeneous material 6' can intercommunicate with the enveloping layer 8 via the first hook portion 611', followed by sintering the dewaxed enveloping layer 8 to form the integrally formed shell mold 4, allowing the first hook portion 611' of the embedded portion 61' to be stably embedded in the casting portion 42 of the shell mold 4.

With reference to FIG. 8, after the molten metal "N" fills in the cavity 421 of the casting portion 42 of the shell mold 4 by the gravity pouring process, the molten metal "N" can enclose the portion of the heterogeneous material 6' located in the cavity 421 to obtain the cast product of the golf club head. Then, the first hook portion 611' of the embedded portion 61' of the heterogeneous material 6' is milled by a miller to remove the protruding part, and the end surface of the heterogeneous material 6' is drilled along an axial direction by a driller to form a hole for coupling to a handle. Accordingly, the use of the heterogeneous material 6' having a smaller density than the cast material can reduce the weight of the hosel for other parts of the golf club head. Moreover, the gravity center of the golf club head can be changed to a higher position if a heterogeneous material 6' having a larger density than the cast material is used, improving the performance of the golf club head hitting a golf ball.

More importantly, when the casting method of the application is used to manufacture a golf club head having the heterogeneous material 6' embedded at the hosel of the golf club head, the coupling strength between the heterogeneous material 6' and the cast material is significantly increased by the casting process, effectively reducing loosening between the heterogeneous material 6' and the cast material resulting from a different thermal expansion coefficient therebetween. Moreover, the heterogeneous material 6' and the cast material can be coupled with each other during the formation of the golf club head without requiring a later welding work, greatly simplifying the manufacturing process of the golf club head and improving the efficiency in manufacturing the golf club head.

Figure 14:
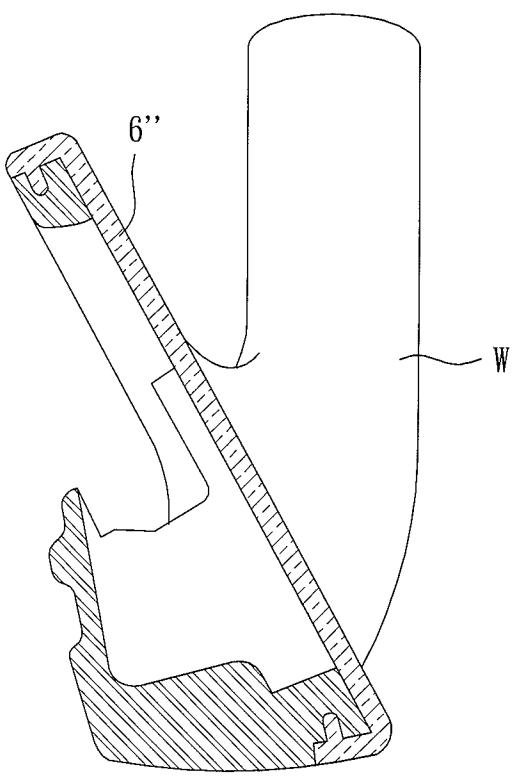
FIG. 14 is a diagrammatic cross sectional view of the cast product of another embodiment having the striking faceplate provided with the heterogeneous material.
Figure 13:
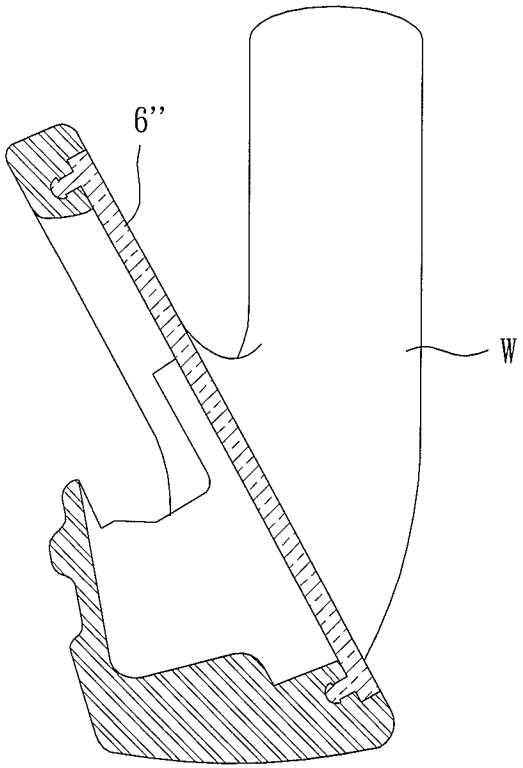
FIG. 13 is a diagrammatic cross sectional view of the cast product of an embodiment having the striking faceplate provided with the heterogeneous material.

The heterogeneous materials 6, 6' are used as counter weights to change the gravity center of the golf club head in the embodiments as mentioned above. The following embodiment is made to explain the use of the heterogeneous material 6" for adjusting the feeling of the user hitting a golf ball using such a produced golf club head. Referring to FIGS. 13 and 14, the heterogeneous material 6" in this embodiment is arranged on the striking face of the golf club head, and the heterogeneous material 6" as enclosed by the cast material can be finally shaped to form various types of striking faces, such as a "face insert" type, a "L-Cup" type, a "C-Cup" type or a U-Cup "type." The shell molds and the pouring process in the embodiment are similar to the previous embodiments, which can be readily appreciated by a person having ordinary skill in the art.

Similarly, when the casting method of the application is used to manufacture a golf club head having the heterogeneous material 6" arranged on the striking face of the golf club head, the coupling strength between the heterogeneous material 6" and the cast material is significantly increased by the casting process, effectively reducing loosening between the heterogeneous material 6" and the cast material resulting from a different thermal expansion coefficient therebetween. Moreover, the heterogeneous material 6" and the cast material can be coupled with each other during the formation of the golf club head without requiring a later welding work, greatly simplifying the manufacturing process of the golf club head and improving the efficiency in manufacturing the golf club head.

In view of the foregoing, the casting method for manufacturing a golf club head having an embedded heterogeneous material according to the present invention can reduce the chemical reaction of the cast material with air during the smelting process, which not only reduces the formation of the oxide layer on the surface of the heterogeneous material, but also improves the coupling strength between the heterogeneous material and the cast material whether the cast material includes active metals or not. Therefore, the casting method for manufacturing a golf club head having an embedded heterogeneous material according to the present invention can improve the yield rate and the quality of the cast product.

Furthermore, the casting method for manufacturing a golf club head having an embedded heterogeneous material according to the present invention can improve the flowability of the molten metal in the shell mold by the pouring process under a centrifugal force in the vacuum environment, reducing the required temperature used for preheating the shell mold. Therefore, the thermal expansion of the heterogeneous material can be reduced, and the enhanced coupling effect between the cast material and the heterogeneous material can be maintained.

Moreover, the casting method for manufacturing a golf club head having a heterogeneous material according to the present invention can provide the desired pressing effect of the molten metal under the centrifugal force during solidification of the molten metal "N" without using extra cast material and energy. Thus, the casting method for manufacturing a golf club head having a heterogeneous material according to the present invention is capable of reducing the manufacturing cost.

In addition, the shell mold according to the present invention can improve the coupling strength between the cast material and the heterogeneous material of the cast product of the golf club head.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A method for manufacturing a golf club head having an embedded heterogeneous material, comprising:

placing a shell mold on a rotary table, with the shell mold comprising a crucible portion, a casting portion, and a coupling portion in intercommunication between the crucible portion and the casting portion, with the casting portion comprising a cavity;

partially embedding a heterogeneous material in the casting portion of the shell mold, wherein the heterogeneous material comprises an embedded portion embedded in the casting portion of the shell mold and a non-embedded portion remaining in the cavity of the casting portion;

placing a metal ingot in the crucible portion of the shell mold;

melting the metal ingot in the crucible portion of the shell mold into molten metal in a vacuum environment with an activated heater, with the activated heater surrounding the crucible portion of the shell mold and heating the crucible portion;

rotating the rotary table, causing the molten metal to flow into the cavity of the casting portion under a centrifugal force generated by rotation;

enclosing the non-embedded portion of the heterogeneous material with the molten metal;

gradually slowing down the rotary table after the molten metal cools and solidifies until the rotary table stops;

destroying the shell mold after the molten metal completely solidifies to obtain a casting comprising a cast product portion;

separating the cast product portion from the casting to obtain a cast product of a golf club head, with the embedded portion protruding from an outer periphery of the cast product of the golf club head; and milling the outer periphery of the cast product of the golf club head to remove the embedded portion that protrudes from the outer periphery of the cast product of the golf club head.

2. The casting method for manufacturing the golf club head having an embedded heterogeneous material as claimed in claim 1, further comprising forming the shell mold, with forming the shell mold comprising:

preparing a wax blank comprising a crucible blank, a casting blank, a coupling blank and the heterogeneous material, with the coupling blank having an end connected with an outer periphery of the crucible blank and another end connected with the casting blank, with the non-embedded portion of the heterogeneous material remaining in the casting blank and the embedded portion of the heterogeneous material protruding from the outer periphery of the casting blank;

forming an enveloping layer on an outer surface of the wax blank;

heating the wax blank and the enveloping layer to melt the wax blank;

after heating the wax blank and the enveloping layer, sintering the enveloping layer at a high temperature to form the shell mold; and integrally forming the crucible portion, the coupling portion and the casting portion of the shell mold together.

3. The method for manufacturing the golf club head having an embedded heterogeneous material as claimed in claim 2, with forming the shell mold further comprising:

partially embedding the heterogeneous material in a molten wax in an injection molding manner, to form the casting blank after the molten wax cools and solidifies.

4. The method for manufacturing the golf club head having an embedded heterogeneous material as claimed in claim 2, with rotating the rotary table comprising:

rotating the rotary table at a speed of 200-700 rpm, to allow the molten metal to flow into the cavity of the casting portion, to fill the cavity of the casting portion with the molten metal.

5. The method for manufacturing the golf club head having an embedded heterogeneous material as claimed in claim 4, further comprising:

maintaining the speed of the rotary table at 200-700 rpm for 10-30 seconds; and gradually slowing down the rotary table until the rotary table stops after the molten metal completely cools and solidifies.

6. The method for manufacturing the golf club head having an embedded heterogeneous material as claimed in claim 5, with destroying the shell mold comprising:

removing the shell mold from the rotary table after the rotary table is completely stopped; and restricting the shell mold from movement for a period of time.

7. The method for manufacturing the golf club head having an embedded heterogeneous material as claimed in claim 5, further comprising:

constantly cooling the shell mold on the rotary table after the rotary table stops rotating; with destroying the shell mold comprising removing and destroying the shell mold from the rotary table after the molten metal in the shell mold completely solidifies.

8. The method for manufacturing the golf club head having an embedded heterogeneous material as claimed in claim 1, further comprising:

moving the activated heater upward to a preset location surrounding the crucible portion by a lift controller and moving the activated heater downward to a position not surrounding the crucible portion by the lift controller after the metal ingot is melted into the molten metal.

9. The method for manufacturing the golf club head as claimed in claim 8, with placing the shell mold comprising forming the shell mold, with forming the shell mold comprising:

preparing a wax blank comprising a crucible blank, a casting blank, a coupling blank and the heterogeneous material, with the coupling blank having an end connected with an outer periphery of the crucible blank and another end connected with the casting blank, with the non-embedded portion of the heterogeneous material remaining in the casting blank and the embedded portion of the heterogeneous material protruding from the outer periphery of the casting blank;

forming an enveloping layer on an outer surface of the wax blank;

heating the wax blank and the enveloping layer to melt the wax blank;

after heating the wax blank and the enveloping layer, sintering the enveloping layer at a high temperature to form the shell mold; and integrally forming the crucible portion, the coupling portion and the casting portion of the shell mold together.

10. The method for manufacturing the golf club head as claimed in claim 9, with preparing the casting blank comprising preparing the casting blank having a filling portion on a surface of the heterogeneous material, with the filling portion adjacent to the heterogeneous material, with the filling portion being in a form of a protruded edge or a plurality of protruded spots.

11. The method for manufacturing the golf club head as claimed in claim 1, with partially embedding comprising partially embedding the heterogeneous material with the embedded portion comprising a first hook portion with a maximum sectional width larger than a sectional width of a part of the embedded portion that is connected to the non-embedded portion.

12. The method for manufacturing the golf club head as claimed in claim 11, with partially embedding comprising partially embedding the heterogeneous material with the non-embedded portion comprising a second hook portion having a maximum sectional width larger than a sectional width of a part of the non-embedded portion that is connected to the embedded portion.

13. The method for manufacturing the golf club head as claimed in claim 1, with partially embedding comprising partially embedding the heterogeneous material with the non-embedded portion comprising a taper with a sectional width reducing from the non-embedded portion to the embedded portion.

14. The method for manufacturing the golf club head as claimed in claim 1, with partially embedding comprising partially embedding the heterogeneous material with the embedded portion of the heterogeneous material having an average cross sectional area smaller than an average cross section area of the non-embedded portion of the heterogeneous material.

15. The method for manufacturing the golf club head as claimed in claim 1, with partially embedding comprising partially embedding the heterogeneous material with the non-embedded portion of the heterogeneous material comprising a large sectional area region and a small sectional area region, with the small sectional area intercommunicating with the embedded portion of the heterogeneous material and the large sectional area region, with a maximum sectional area of the small sectional area smaller than ⅔ and larger than 1/10 of the minimum sectional area of the large sectional area, forming a distance between the large sectional area of a casting cover portion and an inner periphery of the cavity.

* * * * *